US009945542B2

(12) United States Patent
Evitt

(10) Patent No.: US 9,945,542 B2
(45) Date of Patent: Apr. 17, 2018

(54) LIGHTING DEVICE

(71) Applicant: THE WAND LITE COMPANY LIMITED, London (GB)

(72) Inventor: Jonathan Evitt, London (GB)

(73) Assignee: THE WAND LITE COMPANY LIMITED, London (GB)

( * ) Notice: Subject to any disclaimer, the term of this patent is extended or adjusted under 35 U.S.C. 154(b) by 233 days.

(21) Appl. No.: 14/440,334

(22) PCT Filed: Nov. 4, 2013

(86) PCT No.: PCT/GB2013/052876
§ 371 (c)(1),
(2) Date: May 1, 2015

(87) PCT Pub. No.: WO2014/068335
PCT Pub. Date: May 8, 2014

(65) Prior Publication Data

US 2015/0285472 A1 Oct. 8, 2015

(30) Foreign Application Priority Data

Nov. 2, 2012 (GB) ..... 1219792.7
Dec. 24, 2012 (GB) ..... 1223391.2

(51) Int. Cl.
*F21V 19/00* (2006.01)
*F21V 17/00* (2006.01)
(Continued)

(52) U.S. Cl.
CPC ..... *F21V 19/003* (2013.01); *F21K 9/27* (2016.08); *F21V 3/02* (2013.01); *F21V 3/049* (2013.01);
(Continued)

(58) Field of Classification Search
CPC ..... F21V 19/003; F21V 3/02; F21V 3/049; F21V 7/0066; F21V 17/007; F21V 23/06; F21K 9/27; H01R 13/5219
See application file for complete search history.

(56) References Cited

U.S. PATENT DOCUMENTS 5,132,885 A 7/1992 Hocheim et al.
6,409,361 B1 * 6/2002 Ikeda ..... F21V 19/0025 362/227
2005/0162850 A1 * 7/2005 Luk ..... H05B 33/0857 362/227

FOREIGN PATENT DOCUMENTS

JP 2000-268604 A 9/2000
JP 2009-123686 A 6/2009
(Continued)

OTHER PUBLICATIONS

International Search Report and Written Opinion for PCT/GB2013/051792, dated Dec. 20, 2013.
(Continued)

*Primary Examiner* — Mary Ellen Bowman
(74) *Attorney, Agent, or Firm* — Donald E. Stout; Stout, Uxa & Buyan, LLP

(57) ABSTRACT

A lighting device (1) that includes a light transmissive tube (2), a support (4) to which a series of light emitting elements (7) are mounted and a connector (5) for connecting the light emitting elements to a power source. The support (4) is formed of a planar resilient material twisted or wound into a spiral or helix and received within and constrained by an inner circumferential surface of the tube (2) such that it is mounted directly to and/or in interference fit with the tube (2).

20 Claims, 7 Drawing Sheets

(51) Int. Cl.

| | |
|---|---|
| ***F21V 3/02*** | (2006.01) |
| ***F21V 3/04*** | (2018.01) |
| ***F21V 7/00*** | (2006.01) |
| ***F21V 23/06*** | (2006.01) |
| ***H01R 13/52*** | (2006.01) |
| ***F21K 9/27*** | (2016.01) |
| *F21V 31/00* | (2006.01) |
| *F21Y 115/10* | (2016.01) |
| *F21Y 103/30* | (2016.01) |
| *F21Y 107/10* | (2016.01) |
| *F21Y 107/30* | (2016.01) |

(52) U.S. Cl.

CPC ..... *F21V 7/0066* (2013.01); *F21V 17/007* (2013.01); *F21V 23/06* (2013.01); *H01R 13/5219* (2013.01); *F21V 31/005* (2013.01); *F21Y 2103/30* (2016.08); *F21Y 2107/10* (2016.08); *F21Y 2107/30* (2016.08); *F21Y 2115/10* (2016.08)

(56) References Cited

FOREIGN PATENT DOCUMENTS

| | | | |
|---|---|---|---|
| JP | 2009-289724 | A | 12/2009 |
| JP | 2011-108424 | A | 6/2011 |
| WO | 2009115095 | A1 | 9/2009 |
| WO | 2010136333 | A1 | 12/2010 |

OTHER PUBLICATIONS

Office Action dated Aug. 22, 2017 for corresponding Japanese Pat. App. No. 2015-540214.

* cited by examiner

LIGHTING DEVICE

This invention relates generally to lighting devices such as low energy lighting tubes, for example for use in displays, homes, workplaces and other public or private locations. More specifically, although not exclusively, it relates to Light Emitting Diode (LED) tube lighting where multi directional light is desirable.

Lighting in general can represent a major cost when used regularly or extensively, and as such it has become desirable to utilise light fixings that are efficient, inexpensive to run and have a long lifetime. Lighting for display systems for use in, e.g. exhibition stands and or in shops present a further challenge in that they must be transportable, durable, and easy to assemble and disassemble.

Incandescent light bulbs are generally inefficient, expensive to operate, and have a short life time. Fluorescent tubes are more efficient and have a longer life-time, but take a long time to reach full intensity. Furthermore they often contain harmful chemicals such as mercury and pose a hazard from glass shards if broken.

LEDs consume a low level of electricity while in use, are small, easily available, highly durable and safe to use.

Korean document KR10-2012-0062395 discloses a lighting device wherein 6 rows of LEDs are disposed around a hexagonal core. While the device provides light in multiple directions, the LEDs suffer from bright spots due to the proximity of the LEDs and the outer tube. Furthermore, such a device is complex and expensive to manufacture.

US2005/162850 discloses a lighting device wherein the LEDs are disposed within a tube on a rectangular support with diamond cut-outs. The LEDs are arranged facing internally in a regular but non-uniform pattern, so the device also suffers from bright spots. The device emits light in opposite directions in a single plane, but is less intense in a plane perpendicular to the first.

Accordingly, it would be desirable to provide a lighting device which at least mitigates one or more of the disadvantages of current solutions.

It is a more specific, non-exclusive object of the invention to provide an LED light tube which provides light evenly in multiple directions from the tube, while still maintaining the energy efficiency, durability and safety of the LED elements. It is a more general, non-exclusive object of the invention to provide an improved lighting device, e.g. using less power.

In accordance with a first aspect of the invention there is provided a lighting device comprising a light transmissive tube, a support or substrate or strip to which a series of light emitting members or elements are mounted and optionally a connector for connecting the light emitting members or elements to a power source, wherein the support or substrate or strip is mounted or secured directly to and/or in interference fit with an inner surface or inner circumferential surface of the tube.

The term connector as used herein means any means by which power may be supplied from a power source to the light emitting members or elements. The connector need not be a physical connector, e.g. it may be replaced by any suitable means, which may incorporate a non-contact power supply arrangement such as an inductive power supply arrangement or any other suitable means.

Preferably, the series of light emitting members and/or the support may, but need not, comprise a spiral or helix and/or be mounted along a spiral or helical path.

According to a second aspect of the invention, there is provided a lighting device comprising a light transmissive tube, a series of light emitting members or elements mounted along a spiral or helical path within the tube and optionally a connector for connecting the light emitting members or elements to a power source.

Mounting the series of light emitting members or elements along a spiral or helical path improves light distribution, whereby significantly less light emitting members or elements may be used to produce a 360° distribution of light emitted from the tube. For example, the applicant has determined through experimentation that a strip or series of light emitting members or elements that is at least 1.5 times the length of the tube and arranged in a spiral or helical pattern produces exceptional results. Contradistinctively, the arrangements disclosed in the prior art require significantly more light emitting elements, e.g. the arrangement of KR10-2012-0062395 requires six times the tube length. Thus, the present invention provides a cost effective lighting device that consumes less energy.

According to a third aspect of the invention, there is provided a lighting device comprising a light transmissive tube, a support or substrate or strip to which a series of light emitting members or elements are mounted and optionally a connector for connecting the light emitting members or elements to a power source, wherein the support or substrate or strip is mounted directly on or to an inner surface of the tube such that at least two of the light emitting members or elements on the support face a different direction from one another.

The following features apply equally to any of the aforementioned aspects of the invention.

The support may comprise or be formed of a flat or planar material or support, e.g. an initially flat or planar material or support and/or may comprise or be formed of a flexible and/or resilient material. Additionally or alternatively, the support may be may be oriented to face multiple directions, such as by rolling, twisting, curling, winding or forming into a tube or tubular form, spiral, helix or multiple helix and/or received at least partially within and/or in contact with and/or constrained at least partially by the tube, e.g. the inner surface, which may be a circumferential or radial surface or axial surface, of the tube. In some embodiments, the support is twisted and/or wound to form a spiral or helix, e.g. in a tensed or flexed state. Light emitting elements may be disposed on the support and/or be oriented to face multiple directions, e.g. where the support is twisted, curled, wound or formed to be oriented to face multiple directions. The support may further be allowed to expand, e.g. until it contacts the inner surface of the light transmissive tube. Advantageously, at least a portion of the edges, e.g. adjacent edges, of the support may be in contact with one another, for example either extending longitudinally or when in the twisted or wound or spiral or helix condition, e.g. to provide or for providing a substantially constant helical pitch or axial separation, e.g. between passes of the series of light emitting members or elements.

The support may include two or more series of light emitting members or elements, for example formed in two or more helix, e.g. wherein each of the two or more series of light emitting members or elements may be controllable independently from the other or others. At least two of the two or more series may comprise light emitting members or elements that emit light of a different colour and/or at different wavelengths.

The support may be retained or secured or fixed or attached or otherwise held in position, e.g. at each end, such as by abutments that may secure, fix or attach the support axially, or along its length, e.g. at two or more or multiple points or continuously along its length, for example in order to hold the support fixedly in place. The support can be held in place by any combination of friction fitments, adhesives, mechanical fasteners, clamps, interference fitments or any other suitable form of attachment at each terminal end, or a point or points or continuously along its length, either to the tube or to the end connectors or a combination thereof. The support may comprise a material with an adhesive backing or surface or section or sections for easy attachment to the tube or any other component.

Additionally or alternatively, the support may be mounted and/or fixed directly to an inner surface of the tube in any suitable manner. The tube may comprise an intermediate surface or layer or tube, wherein the support may be mounted and/or fixed directly to an inner surface of the intermediate layer or tube. For example it may, but need not, be adhesively fixed to the inner surface or fixed by fasteners or any other suitable means. The adhesives may be in strips, sections, across the entire surface of the support or any area thereof. The adhesive may be pre-formed onto the outer surface of the support for easy application to the inner surface of the tube. The support may comprise a rigid support or any other supporting means.

In one embodiment the support may comprise a base support or strip of printed circuitry, which base support or strip of printed circuitry may be either secure to a planar support material or alternatively it may be secured or adhered directly to the tube. The support or base support or strip of printed circuitry may comprise an integrated strip of light emitting members or elements. In another embodiment, the support may comprise a strip, rod, bar, tube, sheet, strip, box section or any other suitable form. The support may be formed of flexible plastic, plastics material, polymer, resin, rubber, glass, paper, card, or any other suitable material. The support may be transparent or semi-transparent or translucent or opaque, depending on the extent of diffusion required.

Additionally or alternatively, the support could comprise a rigid insert that could be supported between the end connectors and within the tube, and that could provide for light emitting elements to be disposed at different orientations. Such an insert may be a solid cylindrical tube, or solid support with any other cross section, or and light emitting elements could be regularly or irregularly fixed to or incorporated into a surface of the support, for example in rows or in a helix or any other configuration.

The light emitting members or elements preferably face inwardly and/or at least two of the light emitting elements face in different directions. In preferred embodiments, the light emitting elements or members are mounted on an inwardly facing side or surface of the support. The light emitting members or elements may comprise light emitting diodes (LEDs) and/or the support or base support or strip of printed circuitry may be pre-formed or manufactured with the LEDs, e.g. integral therewith or secured thereto. Preferably, said LEDs are conventional semiconductor LEDs, although Organic LEDs, Polymer LEDs, or any other form of LED could also be used without departing from the scope of the invention. The LEDs may emit white light, coloured light of any colour, non-visible wavelengths of light e.g. ultra-violet, or any other form of light. The LEDs may be monochromatic or may emit light at a plurality of wavelengths or may be switchable or controllable to change the wavelength or wavelengths emitted. The LEDs may all be identical, or there may be a variety of different LEDs.

In a preferred embodiment the light transmissive tube comprises a tube of transparent, semi-transparent or translucent material, for example plastic, polymer, resin, rubber, glass or any other suitable material. The light transmissive tube may comprise a tube with a cross sectional shape such as a circle, triangle, square, or any other multi-faced shape. The tube may have defined sharp edges or rounded edges or alternatively, be fully cylindrical. The light transmissive tube may be rigid, flexible, or deformable as required. At least a portion of the tube is preferably straight and/or cylindrical and/or tapered and/or conical. Additionally or alternatively, at least a portion of the tube may comprise a round or elliptical or polygonal or square or rectangular cross-section or any other suitable cross-section. In some embodiments, the tube comprises an extrusion and/or is extruded, while in other embodiments, the tube comprises a blow moulded tube with a first, open end that may include an engaging means or thread and/or a second end, which may be closed or open, e.g. initially closed but cut open by a subsequent step and in yet other embodiments the tube may be injection moulded or rotation moulded or formed of blown glass or by any other method for producing a hollow vessel.

The light transmissive tube may comprise a diffuser, e.g. for diffusing the light emitted by the light emitting elements, for example, a coating on the internal or external or both surfaces of the tube or on the support or on the base support or substrate. Additionally or alternatively, the diffuser may comprise a textured, ridged, patterned, irregular, may include lenses in its thickness and/or have or include one or more colours on and/or integral with and/or applied and/or sprayed on the tube or support or base support or substrate, or any other suitable method of diffusion. In an alternative means, the light transmissive tube may be transparent and the support may comprise the diffuser or coating as described above. In a further alternative embodiment, the diffuser may comprise a separate component to fit in or around the light transmissive tube, e.g. thereby providing a greater distance between the light emitting elements and the diffuser. Additionally or alternatively, the lighting device may comprise one or more or a plurality of beads or other medium including, for example, granules, facetted elements or gems, any of which may be formed of plastic and/or may comprise one or more different colours, or within the light transmissive tube, e.g. to improve the dispersal of light. The lighting device may also comprise one or more reflectors within the tube, which may be cylindrical or polygonal or faceted or irregular or any other shape.

The tube may be linear and/or longitudinal and/or may be curved, bent, circular or formed into any suitable shape.

The support or base support or substrate may also comprise conducting means, e.g. for conducting electricity along its length and/or for powering the light emitting elements. Such conducting means can be integrated into the support or base support or substrate, adhered to the surface, held by a friction or interference fit, or otherwise attached. Such a conducting means could be a wire e.g. a wire made from copper or any other metal, alloy, or conducting material; a strip, sheet or plate made from copper or any other metal, alloy or conducting material; integrated circuit or other circuit structure; or any other means that would conduct electricity.

The conducting means may be formed onto or integrally within a strip, ribbon, sheet or any other shape of plastic, polymer, resin, glass or any other material. Such a component could be adhered to the surface of the support, or held in position by any other means e.g. interference or friction fit, mechanical fasteners. The conducting means may have an adhesive backing or surface or section or sections for simple adhesion to the support.

In some embodiments the connectors may be constructed from plastic, polymer, resin, rubber, metal, a composite or any other suitable material.

The lighting device may comprise a light transmissive tube that is sealed at one terminal end and attached to a single connector at a second, opposite terminal end, or the lighting device may comprise two end connectors at each opposite end of the tube. The connectors may be identical or may be different in design.

The connectors may be inserted within the tube, or may fit around the external surface of one end of the tube and may be either permanently or releasably fixed in position. The fixing may comprise a screw thread, snap fitment, interference fit, mechanical fastening such as screws, bolts or adhesives, or any other suitable method of attaching the end connectors. It is possible that the fixing can be waterproof or water resistant, for increased durability and weather resistance for the device. The connector may comprise a housing including a seal and/or wiper for providing a sealed connection between a power source connector or cable or shaft thereof and the connector or one or more of the lighting members or elements.

One or both of the end connectors may be electrically connected to the light emitting elements or the support or the conducting means on an internal face of the end connector, and provide a means for connecting to wires, cables, plugs, or other electrical conductors or connectors on an external face, for example via a cable, socket or port for a plug or other suitable means. Additionally or alternatively one or both end connectors could be hard wired to a wire or cable with a length for connection to a circuit. Additionally or alternatively, at least one of the connectors may comprise crocodile clips, a plug for connection with a mains supply or a standard, e.g. 12V, supply from a caravan, motor home or boat, or an adaptor for connection with the cigarette lighter socket in an automobile.

End connectors may also be provided with a means suitable for mounting or supporting the tube when in use. Such means may comprise hooks, loops, clips or any other suitable forms of mounting or supporting means. Additionally or alternatively the mounting or supporting means may comprise or be affixed to the tube or to a housing or reflector. The housing or reflector may at least partially surround the tube and/or reflect light emitted therefrom or from the light emitting members or elements and/or may comprise an extrusion or extruded profile. Additionally or alternatively, the lighting device may comprise or be supplied in a container or box, which may form the housing or reflector and/or may comprise a sheet of material, e.g. laminated material that may include or incorporate a foil layer, e.g. for reflecting light emitted from the light emitting members or elements or tube. The housing or reflector may comprise or be connectable to one or more, e.g. a plurality of, solar cells, which may be separate or mounted thereon, e.g. on an intended upper surface thereof and/or connected or connectable to an energy storage means. The lighting device may include one or more batteries or other energy storage means, e.g. that may be rechargeable, or a fuel cell or a capacitor. The batteries or other storage means may be included within a housing, e.g. on the tube or external from the lighting device and/or may be connected to the solar cells or crocodile clips or plug or cigarette lighter adaptor.

It will be understood by a person skilled in the art that the above use of LEDs will result in a lighting device that consumes less energy than a comparable incandescent equivalent, and approximately the same as a low energy fluorescent tube. It is also possible to operate the lighting device to switch between full intensity output and a standby or inoperative mode almost instantaneously. It is also possible to switch between operative and inoperative states at a frequency higher than the human eye is able to detect in order to give the appearance of a continuously operative light. The lighting device in this form of operation consumes less energy than if it was continuously operative.

Advantageously, at least one of the light emitting members or elements is controllable independently of at least one other of the light emitting members or elements. Preferably, the light emitting members include at least two groups, wherein each group is preferably controllable independently.

A further aspect of the invention provides a kit of parts for assembly into a lighting device as described above, which kit may comprise any one or more of the elements of the device as described above.

A yet further aspect of the invention provides a method of assembling a kit of parts, e.g. as described above, into a lighting device, which method may comprise any one or more of the steps described herein or that would be readily appreciated by the skilled person.

A yet further aspect of the invention provides a method of controlling a lighting device as described above, which method may comprise sequentially providing power to a first light emitting member or a first group of the light emitting members and/or thereafter to a second light emitting member or a second group of light emitting members. More preferably, the method comprises providing power alternately between the or a first light emitting member or the or a first group of light emitting members and the or a second light emitting member or the or a second group of light emitting members.

Another aspect of the invention provides a controller that is operatively connectable to the device, e.g. the connector of the device. The controller is preferably configured to sequentially provide power to a first light emitting member or a first group of the light emitting members and/or thereafter to a second light emitting member or a second group of light emitting members. More preferably, the controller is configured to provide power alternately between the or a first light emitting member or the or a first group of light emitting members and the or a second light emitting member or the or a second group of light emitting members.

Another aspect of the invention provides a lighting system comprising a plurality of light tubes as described previously herein, a plurality of connecting means and a controlling unit. The connecting means may transmit electricity for powering the lighting devices, information, data, or instructions or commands for the light tubes or a combination thereof, and may comprise cables, wires, or other means suitable for transporting signals and/or power. The connecting means may be a wire of a single or multiple strands of metal such as copper or any other conducting material, and may transmit a plurality of signals. The connecting means may be permanently connected e.g. hard wired, to the end connectors of the lighting devices, or may be releasable, for example via the use of any combination of socket, plugs, ports, clips or other suitable fitting. The connecting means may comprise a plurality of a multi-core cable, or may be a combination of different cables.

The end connectors of the lighting devices may be configured so that output of one tube may be connected to the input of a second, and vice versa. The lighting devices may be connected in series or in parallel or in any combination thereof with a plurality of other identical low energy lighting devices for forming a lighting system. The lighting devices may be required to be connected to a single connecting means in order to operate, or may require all end connectors to be connected to a connecting means, or any variable in between.

The controlling unit may be able to switch the tubes between operative and inoperative modes, between colours or frequencies of light, and/or flash or strobe the lighting devices at a variable or fixed frequency.

The controlling unit may be able to synchronise the lighting devices so that one tube light or group or groups of tube lights is operative while a further individual tube light or group or groups of tube lights are inoperative. It may be able to switch the tube lights between operative and inoperative states at a frequency higher than the human eye is capable of detecting, for maintaining an illusion of continual operation. It may be possible to synchronise the strobing of a plurality of tube lights so that one or more of the lighting devices appears in continual operation. Furthermore, it may be possible to synchronise the strobing so that an appearance of constant operation is maintained, while consuming less energy than all tube lights in continual operation.

Aspects of the invention provide a computer program element comprising a computer readable program code means for causing a processor to execute a procedure to implement the method described above and/or a computer readable medium embodying such a computer program element and/or a computer readable medium having a program stored thereon, where the program is to make a computer execute a procedure to implement the method described above.

In a further aspect of the invention, there is provided a display stand or plurality of display stands comprising a single or plurality or lighting system of lighting devices as described above, and/or a non-opaque decorative surround or plurality of non-opaque decorative surrounds. The decorative surround or surrounds may comprise a plurality of transparent, semi-transparent or translucent surfaces or coverings. The surfaces or coverings may comprise glass, plastic, polymer, metal, wood, paper, card, fabric material of natural or synthetic or blend of fibres or any other suitable material, or any combination thereof. The surfaces or coverings may take any 2 dimensional or 3 dimensional shape or form and may wholly or partially surround the lighting device or devices.

The lighting device or devices may be configured to emit light in the ultra-violet spectrum so that the decorative surround or surrounds appear brighter.

Embodiments of the invention will now be described by way of example only with reference to the accompanying drawings in which.

Figure 1:
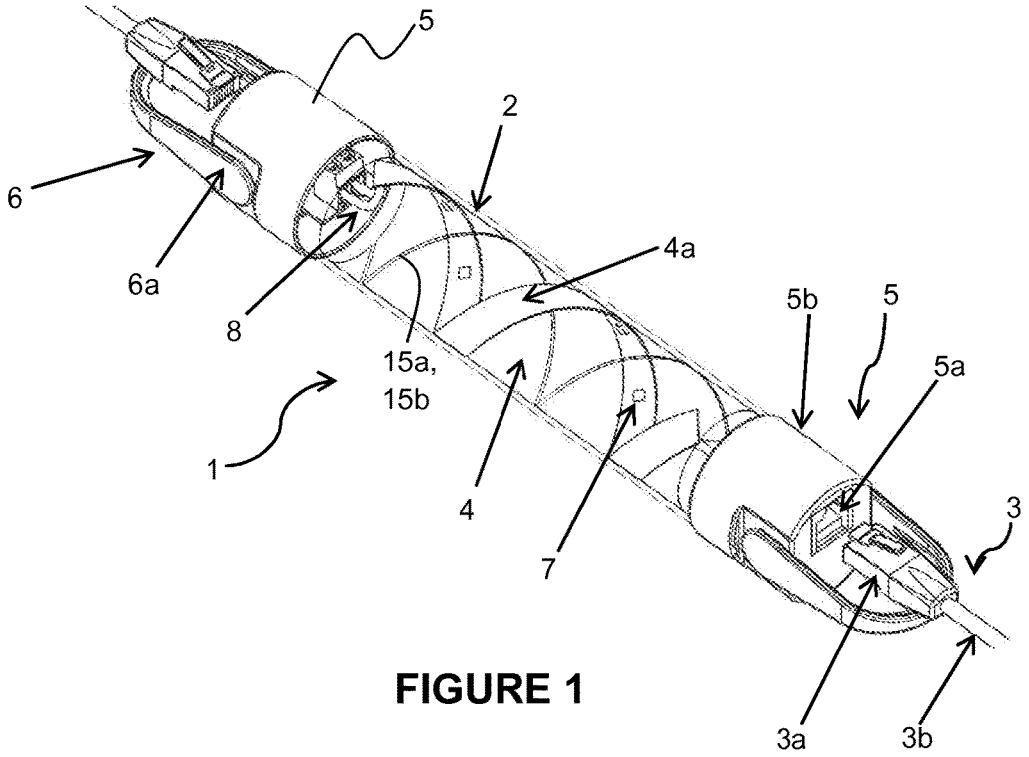
FIG. 1 is a perspective view of a lighting device according to one embodiment of the invention.

Referring now to FIG. 1, there is shown a lighting device 1, comprising a light transmissive tube 2, end connectors 5 and a support 4 for supporting the LEDs 7. The light transmissive tube 2 is an open cylinder of rigid translucent plastic. Within the tube 2 is housed a support 4 constructed from a flexible, transparent, thin plastic sheet. The sheet is twisted into a helix so that the opposing edges 15*a*, 15*b* come into contact and form a tubular supporting means or support 4, and the resulting shape has a tension relative to the strength and flexibility of the material. The contacting edges 15*a*, 15*b* provide a simple mechanism by which a constant axial separation can be achieved for the LEDs 7.

A conductive means or strip 4*a* is fixed to the supporting means or support 4 for transporting power to the LEDs 7. The conductive strip 4*a* is formed of a thin plastic transparent, semi-transparent, translucent or opaque strip of printed circuit board, and adhesively fixed to the support 4 prior to insertion into the tube 2. The printed circuit board preferably incorporates conductive wires that are thin enough to avoid noticeably blocking any light emitted by the LEDs 7. The conductive strip 4*a* are connected to the end connectors 5 via connector wires 8 at each terminal end of the tube 2.

Each end of the light transmissive tube 2 includes an end connector 5 comprising an end cap 5*b* and a connector socket 5*a*. The end connector 5 is produced of a rigid plastics material in this embodiment and is held in place via an interference fit. In addition, the end connector 5 is also provided with a mount 6 in the form of a plastic or metal loop in this embodiment. The mount 6 supports the weight of the lighting device 1 either vertically or at an angle in conjunction with a matching mount 6 at the opposite end of the lighting device 1. The mount 6 is attached to the end connector 5 via hinge points 6*a*, which allow the mount 6 to bend in a direction perpendicular to the lighting device.

Also shown is a supply cable 3, which includes a connector 3*a* and a cable length 3*b*. The supply cable connector 3*a* corresponds to the connector socket 5*a* in end connector 5 for controllably powering the lighting device 1. The cable length 3*b* has a second terminal end with a second connector (not shown) for connecting to another lighting device, controller or source of power (not shown).

Figure 2:
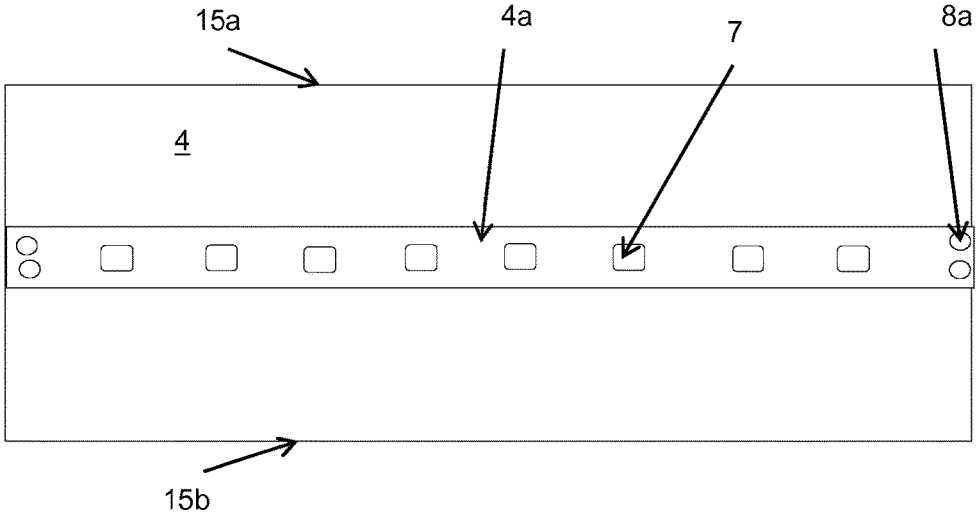
FIG. 2 is a plan view of the supporting member and light emitting elements prior to assembly.

Referring now to FIG. 2, the conducting strip 4*a* includes an adhesive backed strip 14*a* on which the LEDs 7 are mounted and by which they are adhered to the surface of the support 4. Each terminal end of the conducting strip 4*a* is provided with electrical contacts 8*a* which provide contact points for the wires 8 to be connected with the conducting strip 4*a*.

Figure 3:
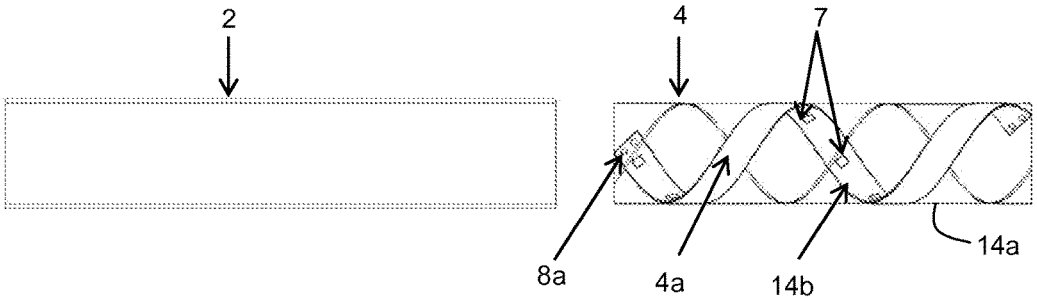
FIG. 3 shows an exploded view of the supporting member in a helical arrangement ready for fitting into the tube or housing.

In order to assemble the lighting device and as depicted in FIG. 3, the support 4 and conducting strip 4*a* with the LEDs 7 are wound or twisted into a spiral or helix having a smaller diameter than the tube 2 and is then inserted into the tube 2. The support 4 and conducting strip 4*a* are then released to expand into an interference fit with the tube 2. Upon relaxation of the tension in the support 4, the angle of the twists adjusts in order to expand the diameter of the resultant tubular support 4 until the support 4 is in contact with the tube 2 and can expand no further. The support 4 can then be adjusted longitudinally so that adjacent edges of the support 4 abut one another to ensure a substantially constant helical pitch between adjacent passes of the conducting strip 4*a*. The resulting shape is broadly cylindrical, and the conducting means 4*a* follows a helical path.

The series of LEDs 7 is held in place within the tube 2 by the preload that results from the unravelling force exerted by the support 4, which urges an external surface 14*a* thereof against the inside of the tube 2. The internal surface 14*b* of the conductive means 4*a* has the LEDs 7 mounted at regular intervals along its length so that the LEDs face the opposing face of the tube. In alternative embodiments, the adhesive backed LED strip is mounted directly to the tube without an intermediate support 4.

Figure 4:
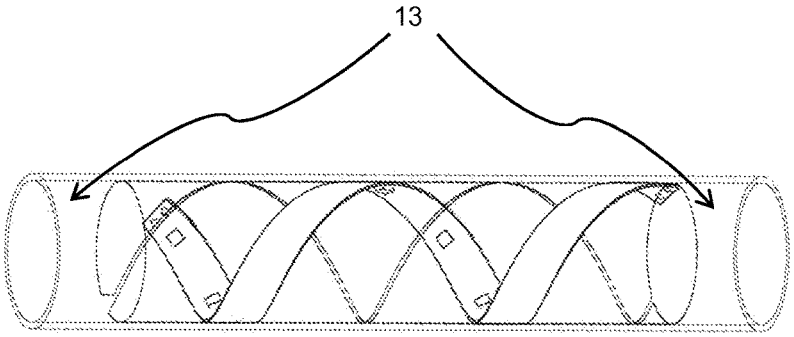
FIG. 4 shows the supporting member and light emitting elements of FIG. 3 fitted in the housing.

FIG. 4 shows a partially constructed lighting device, whereby the support 4 has been inserted into the tube 2. The tube 2 has a greater longitudinal length than the oriented support 4 so that end portions 13 may be left free at each end for connection to an end connector 5.

Figure 5:
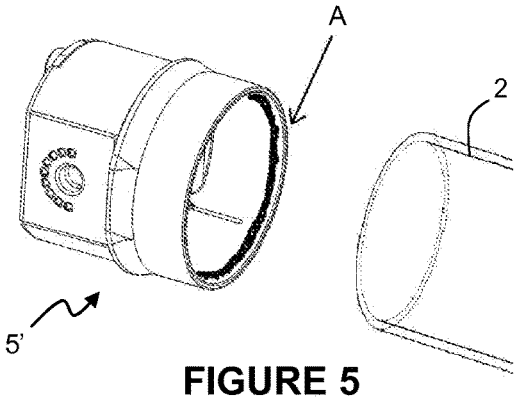
FIG. 5 illustrates the fitting of the tube of a lighting device according to the invention in an end connector according to another embodiment.
Figure 6:
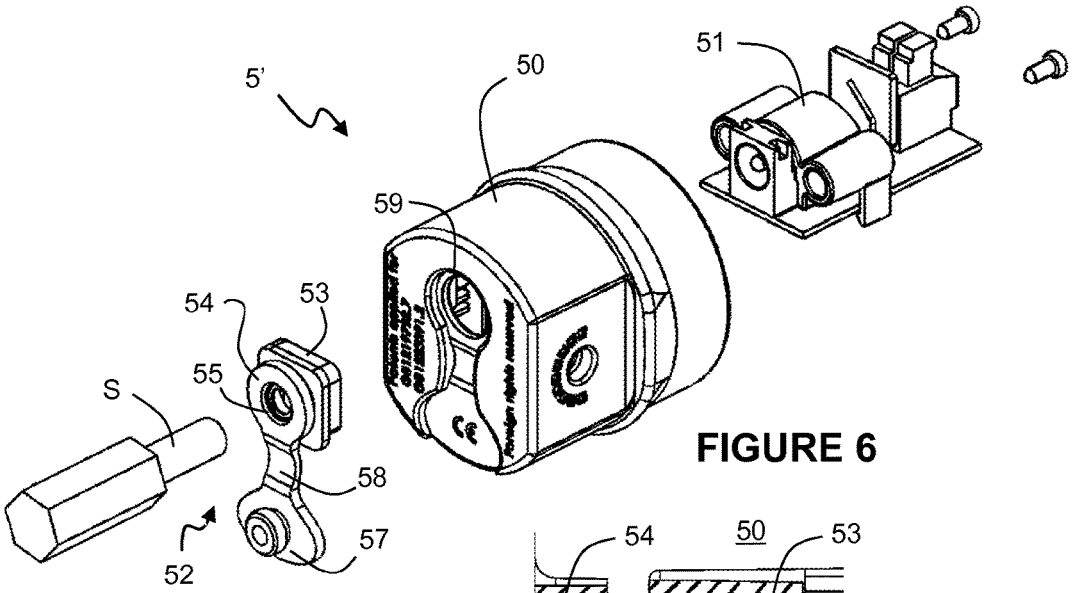
FIG. 6 is an exploded view of the end connector of FIG. 5.
Figure 7:
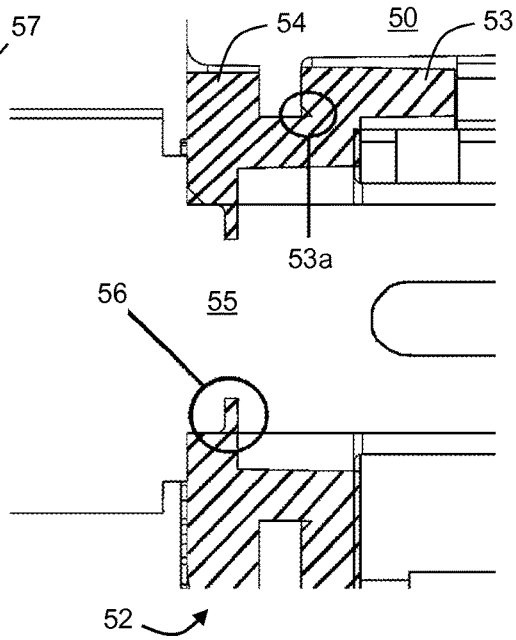
FIG. 7 is a partial sectional view of the end connector of FIGS. 5 and 6 in an assembled condition.

FIGS. 5, 6 and 7 illustrate features of a further end connector 5' that make the lighting device waterproof or water resistant, for increased durability and weather resistance for the device. The end connector 5' is sealingly engaged with the tube 2 by an adhesive A placed within a receptacle of the end connector 5' prior to assembly, as shown in FIG. 5. FIGS. 6 and 7 show details of the connector assembly 5', which includes a housing 50 into which a printed circuit board (PCB) 51 is received and which is sealed by a seal member or bung 52. The seal member 52 includes an inner, enlarged portion 53 with an undercut 53*a*, a flange 54, a hole 55 with a circumferential wiper 56 and a lid 57 connected to the flange 54 by a hinge portion 58 for sealingly closing the hole 55 when the connector is not in use. The enlarged portion 53 of the seal member 52 is inserted into a hole 59 in the housing 50 such that the wall of the housing 50 is captive between the enlarged portion 53 and the flange 54 to retain the seal member 52 in place and to seal against the hole 59 in the housing 50. In use, the shaft S of a power source connector cable (not shown) is inserted into the hole 55 and engages with the wiper 56 to provide a sealed connection therebetween.

Figure 8:
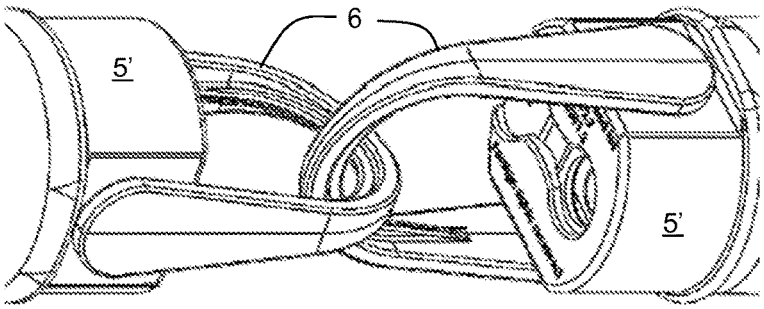
FIG. 8 is a perspective view of a pair of end connectors according to FIGS. 5 to 7 with interengaging hooks.
Figure 9:
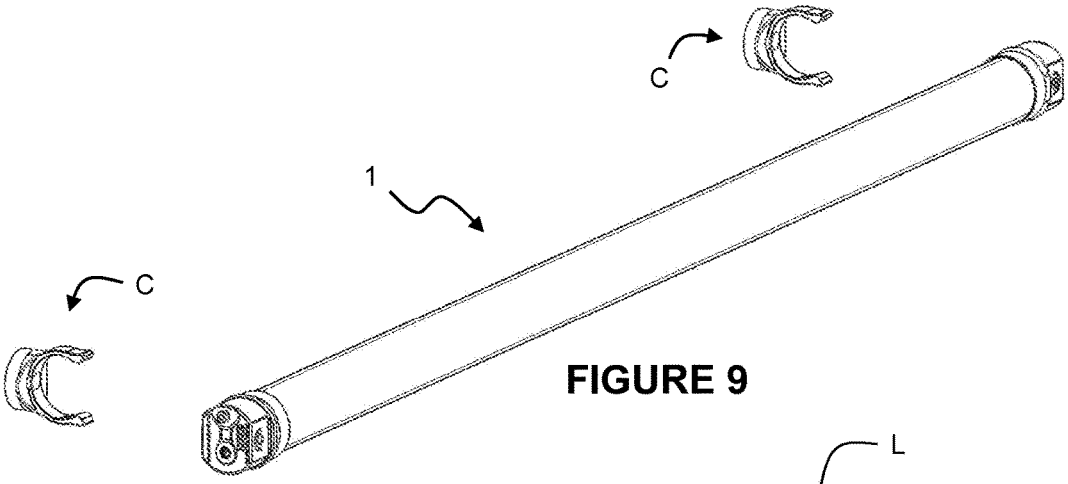
FIG. 9 is an exploded perspective view of a lighting device according to an embodiment of the invention with a pair of wall clips.

FIG. 8 illustrates a pair of end connectors 5' each with a loop 6 in engagement with one another to demonstrate one way of creating a daisy chain of lighting devices 1, while FIG. 9 shows a pair of wall clips C arranged to engage the tube 2 for mounting the lighting device on a wall.

Figure 10:
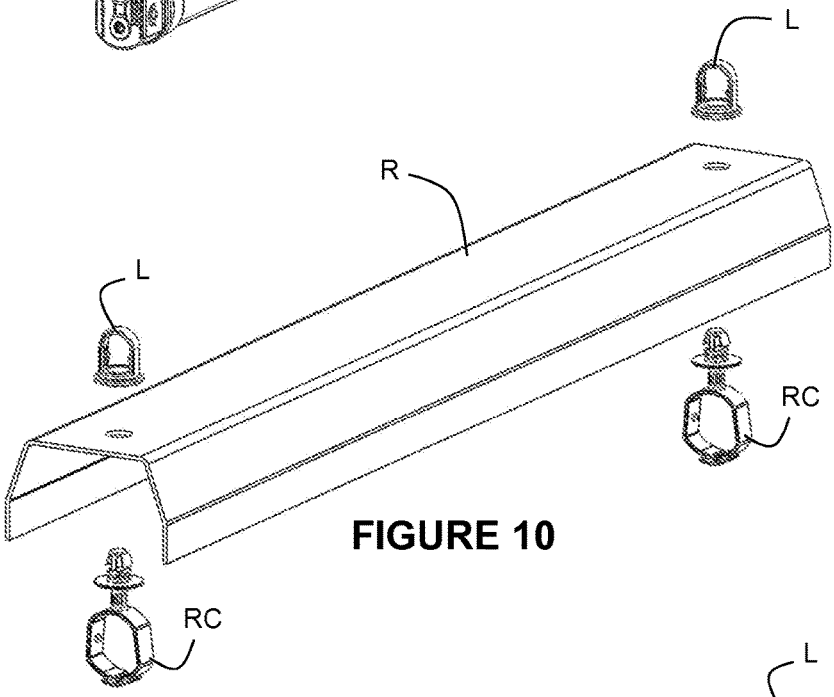
FIG. 10 is an exploded perspective view of a reflector for supporting a lighting device according to the invention.

FIG. 10 shows an exploded view of a reflector R with a substantially U-shaped cross-section and a pair of reflector clips RC each having a lower loop for engaging an end connector 5, 5' and an upper, collapsible head that is received within a respective hole in the reflector R and engages a respective loop L for hanging the reflector R in use.

Figure 11:
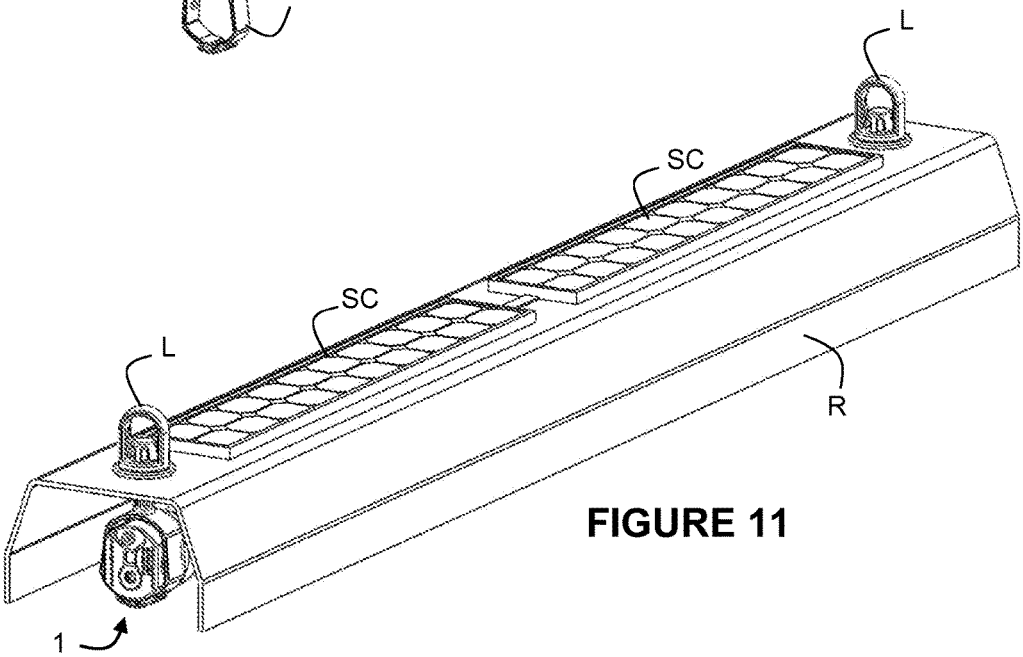
FIG. 11 is a perspective view of an assembled reflector for supporting a lighting device according to the invention with solar cells mounted on an upper surface thereof.

FIG. 11 shows a reflector R in an assembled condition, but with a plurality of solar cells SC on an upper surface thereof. In this arrangement, the lighting device 1 or the reflector R or the assembly preferably includes or incorporates rechargeable batteries that are charged using the solar cells SC.

Figure 12:
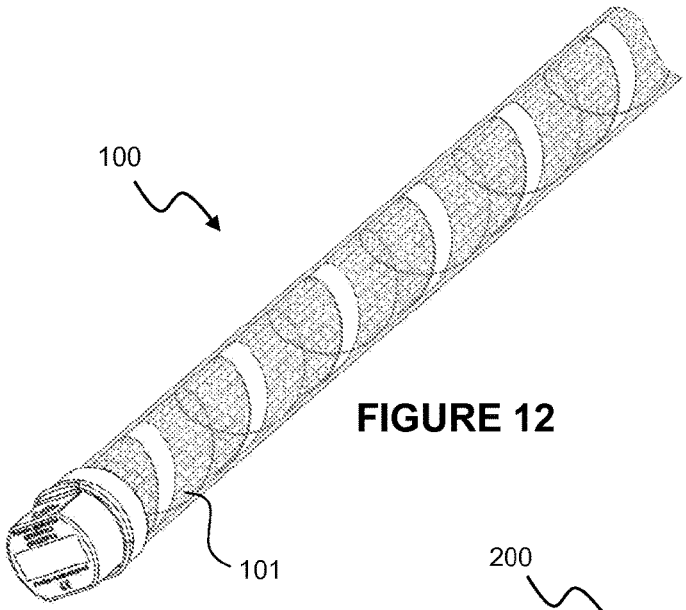
FIG. 12 is a perspective view of a lighting device according to an embodiment of the invention with a plurality of beads contained in the housing.
Figure 13:
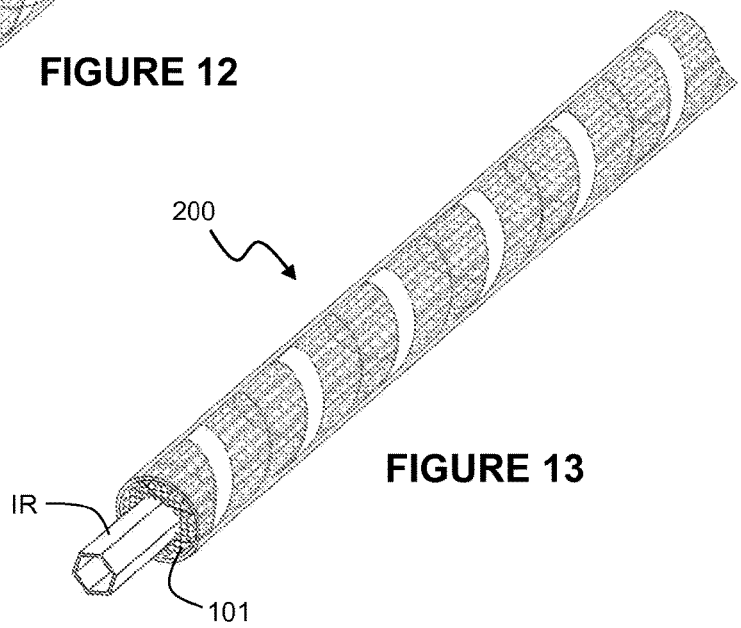
FIG. 13 is a perspective view of a lighting device according to an embodiment of the invention with a plurality of beads and an internal reflector contained in the housing.

FIG. 12 shows a lighting device 100 that includes a plurality of refractive beads 101 received within the tube 2, while FIG. 13 shows a lighting device 200 similar to that of FIG. 12 with a hexagonal internal reflector IR received in the centre of the tube. It will be appreciated that each of these arrangements improves the diffusion of light whilst minimising the effect on the lumen output.

Figure 14:
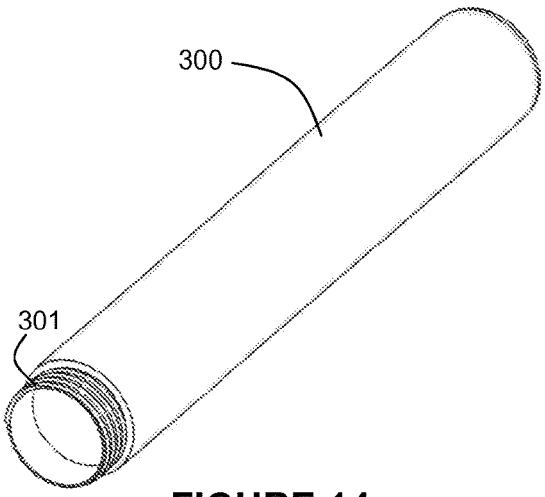
FIG. 14 is a perspective view of a straight blow moulded tube for a lighting device according to an embodiment of the invention.
Figure 15:
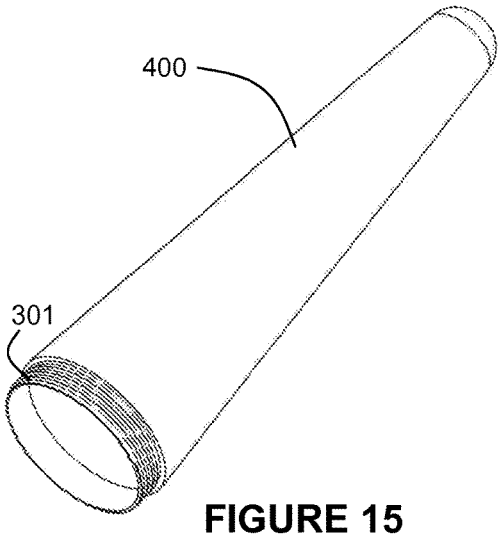
FIG. 15 is a perspective view of a tapered blow moulded tube for a lighting device according to an embodiment of the invention.

FIG. 14 shows a straight tube 300 formed by a blow moulding process with an integral neck finish 301 to which an end connector 5, 5' may be fitted by a threaded engagement. Similarly, FIG. 15 shows a tapered or conical tube 400 also formed by a blow moulding process with an integral neck finish 401.

In a preferred embodiment, a lighting system is provided that incorporates the lighting device 1, 100, 200 described above and a controller (not shown) that selectively provides power to individual LEDs 7 or groups of LEDs 7. More specifically, the controller is configured to sequentially provide power to a first LED 7 or group of LEDs 7 and thereafter to a second LED 7 or group of LEDs 7. In order to reduce power consumption and extend the life of the LEDs, the controller is configured to provide power alternately between the LEDs or groups of LEDs.

Figure 16:
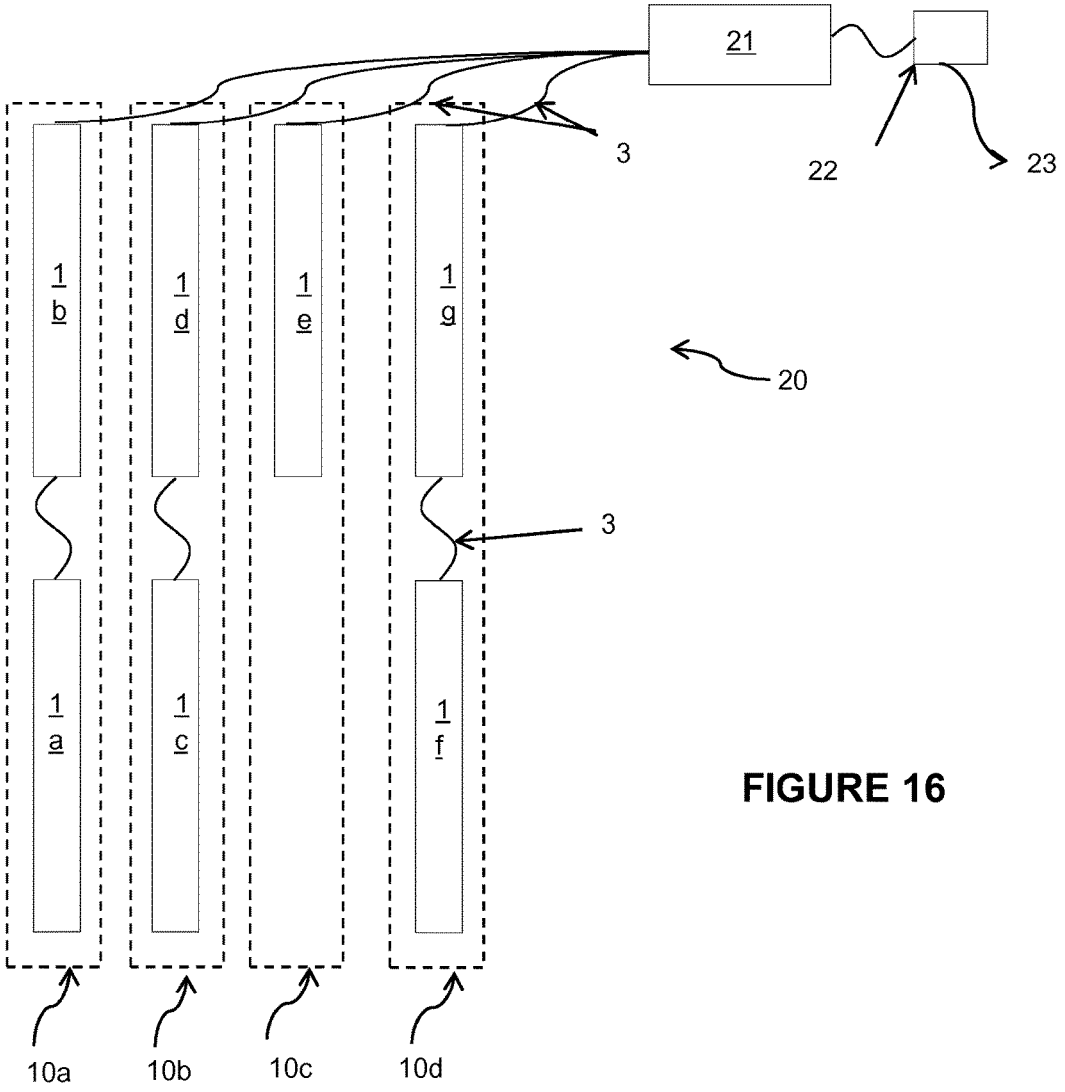
FIG. 16 is a diagram showing a lighting system according to an embodiment of the invention.

Referring now to FIG. 16, there is shown a lighting system 20 that incorporates a plurality of lighting devices 1*a-g*, connected via multiple supply cables 3, and to a controller 21. The controller 21 is connected to a power supply 22, which is in turn connected to an electrical outlet 23.

Lighting devices 1*a* and 1*b* are connected in series by a cable 3 to form group 10*a*; devices 1*c* and 1*d* are connected in series to form group 10*b*; lighting device 1*e* is not connected to any other lighting device forming group 10*c*; and lighting devices 1*f* and 1*g* are also connected in series to form group 10*d*. Groups 10 *a-d* are connected via cables 3 to the controlling means.

As is shown, group 10*a* is connected in parallel with groups b-d and thus lighting devices 1*a* and 1*b* are in parallel to the five remaining lighting devices. The controlling means is capable of operating each group independently from the other groups, such that group 10*a* is operative while the remaining three are in a standby mode. Depending on the degree of control provided by the controller, it may be possible to operate each lighting device within a group independently, such that each lighting device 1*a-g* is independently operable. The power for the lighting devices is drawn from electrical outlet 23, and converted into a suitable voltage by power supply 22. Thus, 7 tubes are powered by a single electrical outlet without a need for an extension lead. This reduces the risk of overloading the electrical outlet resulting in a safer lighting system.

Furthermore, controller 21 is able to strobe the lighting devices at a frequency higher than detectable to the human eye, thereby reducing the energy consumption of each tube. It is possible to synchronise the strobing between groups such that only a single group is lit at any one instant. In this example group 10*a* would be lit while 10*b-d* are in a standby mode. 10*a* is then switched off, 10*b* lit and the remaining two groups continue in their standby mode. This process is continued in this manner until 10*a* returns to a lit state, and the process may be repeated many times per second. The energy consumption of the lighting system will therefore be less than if all lighting devices were continuously operative.

Figure 17:
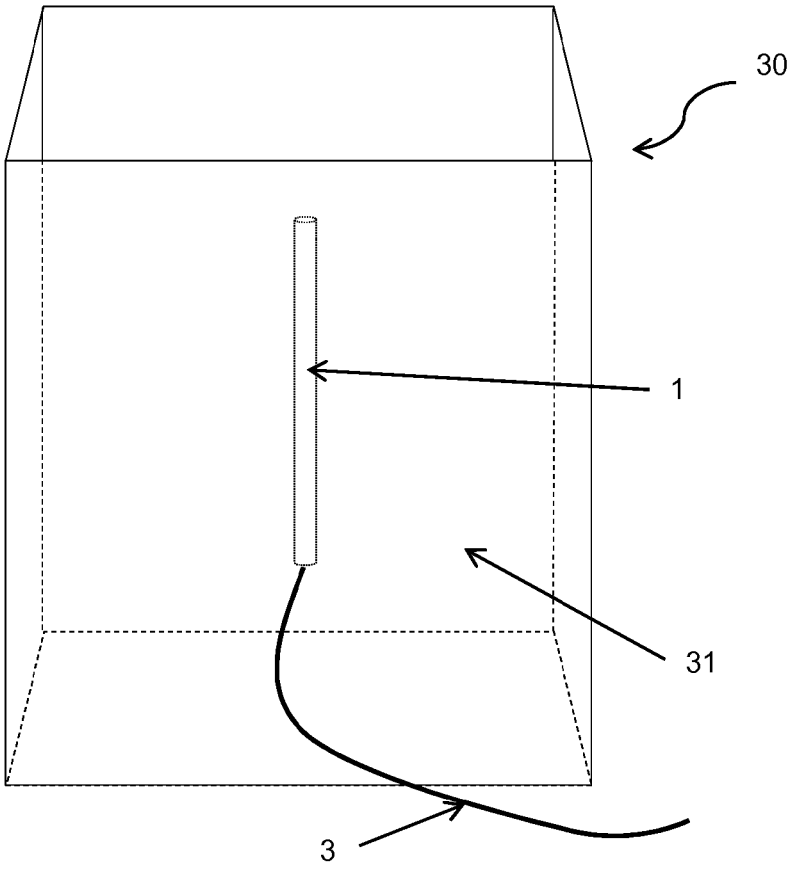
FIG. 17 is a display stand according to an embodiment of the invention.

Referring now to FIG. 17, there is shown a third embodiment of the invention. Shown is a display stand 30, comprising a lighting device 1 and a decorative surround 31. In this diagram, dotted lines depict internal dimensions. The decorative surround is manufactured from a translucent fabric and has been externally decorated (not shown) and is held in place by a supporting frame (not shown). The lighting device 1 is positioned within the decorative surround such that it is not readily visible when inoperative. The tube light is connected by cable 3 to the rest of a lighting system (not shown). In operation, the lighting device 1 is turned on and emits light in all directions. The light shines through the translucent decorative surround, thereby making it more visible, eye catching, and easier to read.

It will be appreciated by those skilled in the art that several variations are envisaged without departing from the scope of the invention. For example, the connector 5, 5' need not be a physical connector, e.g. it may be replaced by any suitable means, which may incorporate a non-contact power supply arrangement such as an inductive power supply arrangement or any other suitable means. The support 4 and light emitting elements 7 may comprise other designs and features as described herein or it may simply comprise the adhesive backed substrate or conductive strip 4*a* itself, which may be mounted directly to the inner surface of the tube. The support 4 may comprise a rectangular sheet rolled into a tubular form with its edges extending longitudinally, rather than along a spiral or helix.

It will be appreciated by those skilled in the art that any number of combinations of the aforementioned features and/or those shown in the appended drawings provide clear advantages over the prior art and are therefore within the scope of the invention described herein.

The invention claimed is:

1. A lighting device comprising a light transmissive tube, a planar support to which a series of light emitting elements are mounted and a connector for connecting the light emitting elements to a power source, wherein the planar support is mounted or secured directly to or in interference fit with an inner surface of the tube and in substantially continuous contact with the inner surface along a spiral or helical path such that the series of light emitting elements are mounted along a spiral or helical path.

2. A lighting device according to claim 1, wherein the support comprises a spiral or helix.

3. A lighting device according to claim 1, wherein the support is formed of a planar resilient material that is rolled or twisted or wound into a tubular form and received at least partially within and constrained at least partially by an inner circumferential surface of the tube.

4. A lighting device according to claim 1, wherein at least a portion of the adjacent edges of the support are in contact with one another.

5. A lighting device according to claim 1, wherein the support comprises a strip including conducting means for conducting power to the light emitting elements.

6. A lighting device according to claim 5, wherein the strip is mounted to a planar resilient material.

7. A lighting device according to claim 5, wherein the strip is mounted or secured directly to the inner surface of the tube.

8. A lighting device according to claim 1, wherein the support is retained axially within the tube between abutments located at the ends of the tube.

9. A lighting device according to claim 1, wherein the support is secured or fixed within the tube by an adhesive between the support and the inner surface of the tube.

10. A lighting device according to claim 1, wherein the light emitting elements are mounted to an inwardly facing side of the support.

11. A lighting device according to claim 1, wherein the light emitting elements comprise light emitting diodes.

12. A lighting device according to claim 1, further comprising a diffuser or diffusion means for diffusing light emitted, in use, by the light emitting elements.

13. A lighting device according to claim 12, wherein at least part of the diffuser or diffusion means is comprised in the tube.

14. A lighting device according to claim 12, wherein at least part of the diffuser or diffusion means is comprised in the support.

15. A lighting device according to claim 1, wherein the connector comprises a housing including a seal and/or wiper for providing a sealed connection with a power source connector or cable.

16. A package including a lighting device according to claim 1, and a container or box for receiving the lighting device, wherein the container or box is adapted to form a reflector for reflecting light emitted, in use, from the lighting device.

17. A kit of parts for assembly into a lighting device according to claim 1, the kit comprising the light transmissive tube, the support, the series of light emitting elements and the connector for connecting the light emitting elements to a power source.

18. A package including a kit of parts according to claim 17 and a container or box for receiving the kit, wherein the container or box is adapted to form a reflector for reflecting light emitted, in use, from the lighting device when assembled.

19. A lighting device comprising a light transmissive tube, a support to which a series of light emitting elements are mounted and a connector for connecting the light emitting elements to a power source, the support comprising a strip mounted or secured directly to the inner surface of the tube by an adhesive between the strip and the inner surface of the tube such that the series of light emitting elements are mounted along a spiral or helical path.

20. A lighting device comprising a light transmissive tube, a planar support to which a series of light emitting elements are mounted and a connector for connecting the light emitting elements to a power source, wherein a major surface of the planar support is mounted or secured directly to or in interference fit with an inner surface of the tube such that the series of light emitting elements are mounted along a spiral or helical path and each light emitting element faces an opposing inner surface of the tube between adjacent passes of the spiral or helical path of the series of light emitting elements.

* * * * *